US005804756A

United States Patent [19]

Christensen

[11] Patent Number: 5,804,756

[45] Date of Patent: Sep. 8, 1998

[54] COMPOSITE/METALLIC GUN BARREL HAVING MATCHED COEFFICIENTS OF THERMAL EXPANSION

[75] Inventor: Roland J. Christensen, Fayette, Utah

[73] Assignee: RJC Development, L.C., Fayette, Utah

[21] Appl. No.: 573,697

[22] Filed: Dec. 18, 1995

[51] Int. Cl.[6] ..... F41A 21/02; F41A 21/20

[52] U.S. Cl. ..... 89/15; 89/16; 42/76.02

[58] Field of Search ..... 42/76.02, 78, 76.01; 89/15, 16, 14.05

[56] References Cited

U.S. PATENT DOCUMENTS

| | | | |
|---|---|---|---|
| H82 | 7/1986 | Dittrich et al. | 89/16 |
| H1365 | 11/1994 | Amspacker et al. | 42/78 |
| 2,847,786 | 8/1958 | Harley et al. | 89/16 |
| 2,935,913 | 5/1960 | Wilson | 89/16 |
| 3,004,361 | 10/1961 | Hammer | 42/76.02 |
| 3,571,962 | 3/1971 | Eig | 42/76.02 |
| 3,641,870 | 2/1972 | Eig | 42/76.02 |
| 3,742,640 | 7/1973 | Thomsen | 42/76.02 |
| 4,435,455 | 3/1984 | Prewo et al. | 42/76.02 |
| 4,641,450 | 2/1987 | Moll et al. | 42/76.02 |
| 4,646,615 | 3/1987 | Gladstone et al. | 42/76.02 |
| 4,669,212 | 6/1987 | Jackson et al. | 89/16 |
| 4,685,236 | 8/1987 | May | 89/15 |
| 4,911,060 | 3/1990 | Greenspan et al. | 89/14.05 |
| 5,125,179 | 6/1992 | Campbell et al. | 42/76.02 |
| 5,214,234 | 5/1993 | Divecha et al. | 89/16 |

FOREIGN PATENT DOCUMENTS

| | | | |
|---|---|---|---|
| 2070071 | 12/1992 | Canada | 42/76.02 |

*Primary Examiner*—Stephen M. Johnson
*Attorney, Agent, or Firm*—Thorpe, North & Western, L.L.P.

[57] ABSTRACT

A composite/metallic gun barrel is disclosed having a metallic liner and alternating first and second groups of fibers wrapped about the liner, the first groups being disposed in a first orientation generally perpendicular to the long axis of the liner, and the second groups including one or more layers disposed generally parallel with the long axis of the metallic liner. By controlling the amount of fibers in each group relative to the other group, the coefficients of thermal expansion in the radial direction can be matched to provide a gun barrel having desirable firing characteristics.

18 Claims, 4 Drawing Sheets

COMPOSITE/METALLIC GUN BARREL HAVING MATCHED COEFFICIENTS OF THERMAL EXPANSION

BACKGROUND OF THE INVENTION

The present invention relates to composite gun barrels for small arms, and in particular, to a gun barrel for small arms wherein the gun barrel is made with a composite portion and a metallic portion formed so that the coefficient of expansion of the composite is matched in the radial direction relative to that of the metal portion of the gun barrel and has 0 or nearly 0 coefficient of thermal expansion in the axial direction so as to achieve desiring firing characteristics and accuracy for the gun barrel.

The use of composite/metallic gun barrels is well known in the art of weapons manufacturing. Typically, composite/metallic gun barrels are made from thin-walled cylinders of metal which are overlaid with a composite material. The composite layer provides increased strength and stiffness to the gun barrel, while simultaneously reducing the weight of the barrel. Thus, a gun simultaneously can be made lighter, stronger and stiffer by not using a conventional metallic barrel.

In most attempts to replace the conventional barrel, however, a thin metallic barrel liner is used. Typically, the metallic portion of the barrel will be less than one-tenth of an inch thick along most of the length of the barrel. The metallic liner serves two major purposes. First, the metallic barrel liner provides a hard, machinable surface for spiral riflings in the liner bore which provide a rotational spin to the bullet during flight and greatly improves accuracy. In contrast, the composite material is not sufficiently hard, is friable, and is otherwise unsuitable for barrel riflings. Second, the metallic barrel liner is used to shield the composite material from the hot, corrosive gasses generated when firing a bullet. As the powder burns to propel the bullet through the barrel, the hot gasses formed by the burning power to propel the bullet contact the barrel. Those skilled in the art will appreciate that such gasses can weaken the composite material under certain circumstances.

One problem which has developed with barrels having a metallic liner surrounded by composite is that they often fail to maintain consistency when repeatedly fired. As a gun is fired several times in rapid succession, the heat generated from the firing of each bullet begins to accumulate in the bore. Because the metal liner and the composite materials generally have somewhat different coefficients of expansion when exposed to heat, a barrel heated by repeated firing can quickly loose its accuracy and consistency. This is due in large part to prior art lack of awareness or inability to form composite/metallic gun barrels, wherein the coefficients of thermal expansion are matched to those of the liner.

In apparent attempts to overcome such problems of the prior art, the present level of skill in the art teaches that it is best to select a metallic liner having a coefficient of thermal expansion which matches the expansion coefficient of the composite being used in the radial direction. This involves the process of first identifying the coefficient of thermal expansion for the composite and then selecting amid a limited number of suitable metals to try and match that same coefficient. However, as will be appreciated by those skilled in the art, the search for a specific metallic liner with similar expansion coefficients to the composite material may not provide the desired characteristics in other areas, such as strength and durability. Additionally, the metallic liner used to match the composite material is not necessarily the best liner for the desired purpose.

Thus, there is a need for a composite/metallic barrel which is formed so that the composite, the metal and their expansion coefficients are matched to provide desired characteristics during firing due to their matched expansion and contraction.

SUMMARY OF THE INVENTION

Thus, it is an object of the present invention to provide a gun barrel made of metal and a composite wherein the gun barrel is resistant to the loss of accuracy or consistency due to repeated firing.

It is an additional object of the present invention to provide a gun barrel for small arms which is lightweight and durable.

It is another object of the present invention to provide a gun barrel which is easy to make, easy to use and is inexpensive.

It is yet another object of the present invention to provide a composite/metallic gun barrel wherein the composite portion of the barrel is configured so as to expand and contract in a substantially similar manner to the metallic portion of the barrel in the radial direction and have nearly 0 coefficient of thermal expansion in the axial direction.

The above and other objects of the invention are realized in specific illustrated embodiments of a composite/metallic gun barrel having matched coefficients of thermal expansion in the radial direction. The gun barrel is made of a metal cylinder which is overwrapped with one or more composite layers. The composite layers are disposed about the metallic cylinder in such an arrangement that the coefficient of expansion for the composite material is selected to match the coefficient of expansion for the preselected, preferred metallic liner in the radial direction and have 0 or nearly 0 coefficient of thermal expansion in the axial direction to achieve a desired barrel performance. Thus, the composite material may be disposed so that it expands and contracts in like directions and in like amounts with the metallic cylinder in the radial direction. Adjustment of the coefficient of thermal expansion of the composite allows selection of more favorable liner materials and offers enhanced ability to fine tune to cooperative relationship of the composite with the metal.

The exact disposition of the composite material, of course, depends both on the composite material and which metal is used for the metallic cylinder of the gun barrel. The composite and its expansion coefficient are matched with the expansion coefficient of the metallic portion of the barrel in a winding pattern to give the composite an effective expansion coefficient which correlates to that of the metallic liner.

In accordance with one aspect of the present invention, the gun barrel is coated with a bonding material and then overlaid with the composite material in a winding pattern configured to give the composite material an effective expansion coefficient which is substantially similar to that of the barrel in the radial direction and a nearly 0 coefficient of thermal expansion in an axial direction.

In accordance with another aspect of the invention, the composite material is wound onto a mandrel in a pattern to give it a predetermined coefficient of expansion and then cured. The composite portion of the barrel is then removed from the mandrel and mounted about a metallic portion of the barrel which has a coefficient of expansion which, when matched with that of the composite portion of the barrel, provides a desired barrel expansion characteristic. The composite/metallic barrel is then mounted to the stock of a gun.

In a presently preferred embodiment of the invention, the composite portion of the gun barrel is formed of alternating layers of composite material wherein one layer is hoop or spiral wound so that the fibers are generally disposed at about a 90 degree angle (±10 degrees) to the long axis of the liner. The next most adjacent layer is overlaid on the hoop/spiral wound layer in a longitudinal placement. Additional layers of composite material disposed in longitudinal orientation may be laid prior to the next hoop/spiral wound layer. Typically, the hoop/spiral wound layer contains composite material in a ratio of between about 1:8 and 1:12, and most preferably about 1:10, (by fiber weight) with the longitudinally placed layers when it is desired to have the composite material match the expansion of a steel barrel liner in the radial direction and nearly 0 coefficient of thermal expansion in the axial direction.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood the embodiments discussed below are exemplary of the principles of the present invention, and are not intended to limit the invention as claimed.

Figure 1:
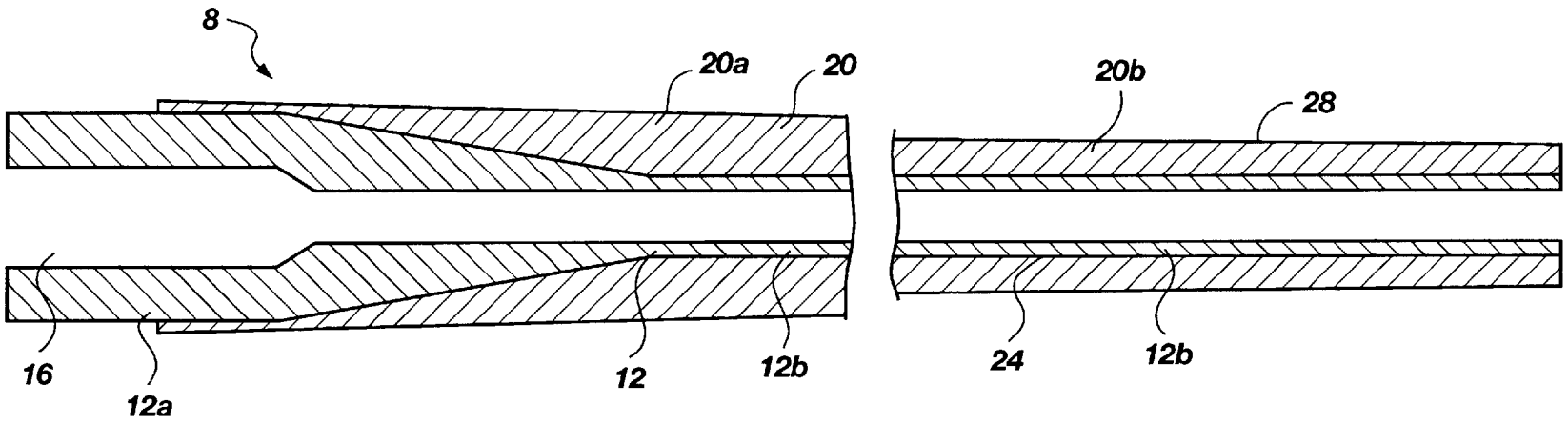
FIG. 1 shows a fragmented, side cross-sectional view of a gun barrel having a composite portion and a metallic portion made in accordance with the principles of the present invention.

Referring to FIG. 1, there is shown a fragmented, side cross-sectional view of a composite/metallic gun barrel, generally indicated at 8, made in accordance with the principles of the present invention. The gun barrel 8 includes a metallic liner 12, which is most typically made of stainless steel. A stainless steel metallic liner 12 is preferred because it is generally less prone to corrosion than other metallic liners.

The metallic liner 12 has a first section 12*a* which is configured to hold a round of ammunition in a chamber 16 formed by the liner, and an elongate second section 12*b* which extends substantially all of the remaining length of the barrel 8. The first section 12*a* is generally thicker than the elongate second section to help withstand the explosive force generated when firing a round of ammunition positioned in the chamber 16. In contrast, the second section 12*b* is thin so as to keep weight of the barrel 8 to a minimum. The primary purpose of the second, elongate section is to channel the hot, explosive gasses generated by firing the round of ammunition out of the barrel.

A casing 20 made of composite material is wrapped about the metallic liner 12. The casing 20 provides strength to the metallic liner 12, but requires less weight than conventional metal barrels. Thus, a barrel 8 which is stronger and lighter than conventional metallic barrels can be made by combining the metallic liner 12 and the composite casing 20. The metallic liner 12 is necessary to shield the composite casing 20 from the hot gasses generated when firing rounds of ammunition. These gasses are typically very corrosive to the composite casing 20 and can lead to premature failure if some sort of shielding is not provided.

The composite casing 20 will typically be made of graphite fibers which are coated with an epoxy material. For convenience, graphite "prepreg" will typically be used. Graphite prepreg is material which has been preimpregnated with an epoxy resin. Such a material can come in sheets which are easier to handle than individual graphite fibers.

As will be discussed in detail below, graphite is the preferred material for the composite casing because of its behavior when heated. Unlike most materials which expand when heated, graphite actually contracts longitudinally. By selectively controlling the contraction of the graphite, gun barrels 8 can be manufactured which have expansion characteristics which are matched to those of the metallic liner.

The composite casing 20 has a first section 20*a* which is disposed adjacent the first section 12*a* of the metallic liner 12*a*, and a second section 20*b* adjacent the second section 12*b* of the metallic liner. To maintain a generally continuous size for the barrel 8 and to ensure sufficient strength along the entire barrel, the first section 20*a* of the casing 20 is thin, tapering inverse to a taper of the first section 12*a* of the metallic liner 12, and the second section is thick so as to provide strength along the elongate second section 12*b* of the liner.

At the exterior of the metallic liner 12 and the interior of the composite casing 20 is an annular interface 24. This interface may be bonded with epoxy or other adhesives. This may be done regardless of whether the composite casing 20 is formed on a mandrel, cured and then placed on the metallic liner 12, or the composite casing 20 is formed about and cured on the liner. Both of these approaches to forming composite/metallic gun barrels 8 will be well known to those skilled in the art.

In addition to the above, the interface 24 between the composite casing 20 and the metallic liner 12 may be substantially nonbonded. The advantages and method for forming a substantially nonbonded composite/metallic gun barrel are discussed in detail in U.S. Pat. No. 5,692,334 (U.S. Ser. No. 08/574,402, filed Dec. 18, 1995).

Disposed about an outer circumference of the composite casing 20 of the gun barrel 8 is an overwrap 28. The overwrap 28 may be a series of helically wound fibers, or preferentially, a knitted or woven cloth made of graphite fibers.

Figure 2:
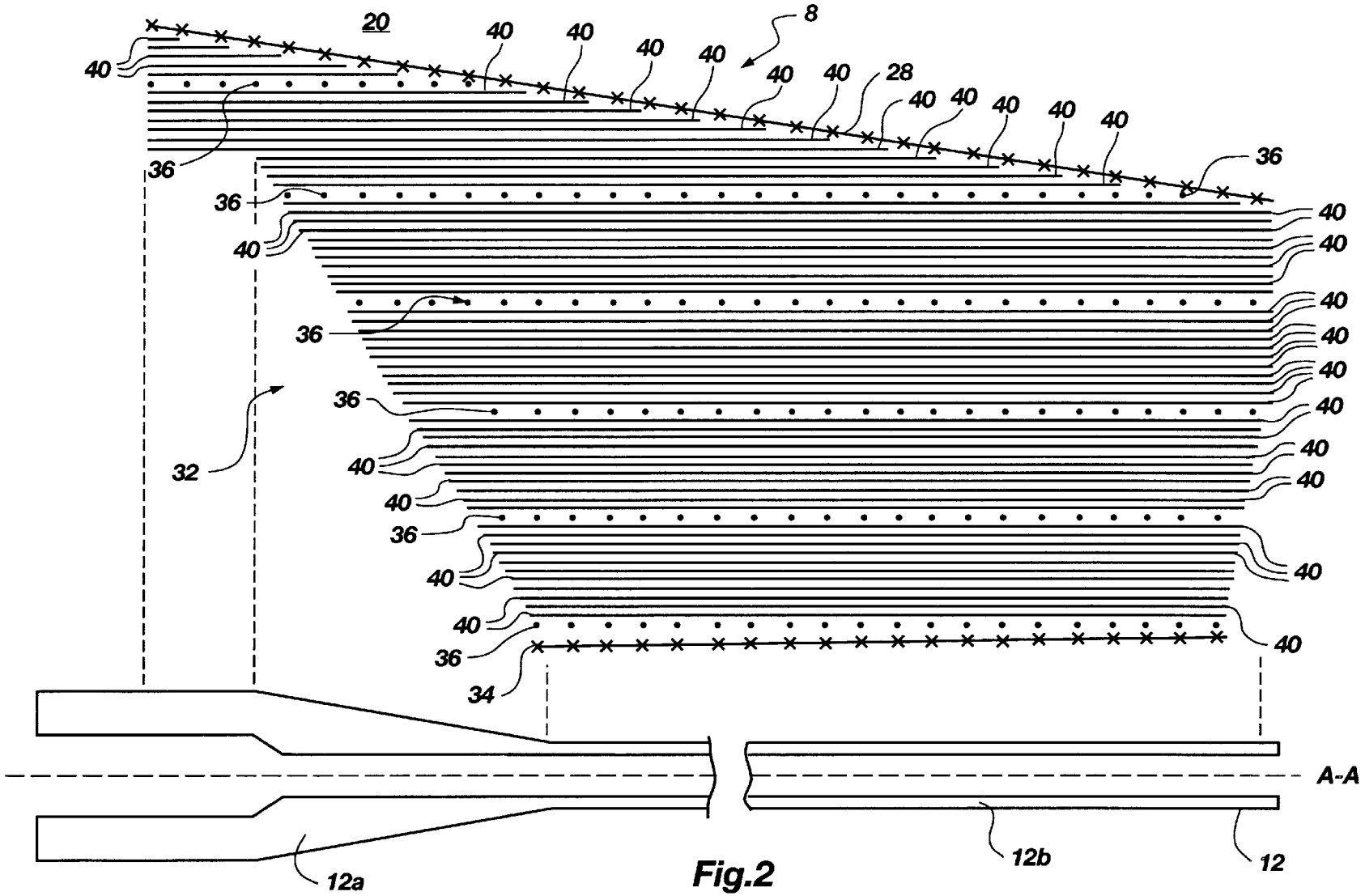
FIG. 2 shows an exploded view of the gun barrel shown in FIG. 1.

Referring now to FIG. 2, there is shown an exploded view of the gun barrel 8 as shown in FIG. 1. The gun barrel 8 includes the metallic liner 12, having the first and second sections, 12*a* and 12*b*, respectively, and the composite casing 20, which includes a plurality of graphite fibers, generally indicated at 32.

The graphite fibers 32 are generally disposed about the metallic liner in first and second groups of fibers 36 and 40, respectively, which are characterized by their orientation. The first group 36 of fibers is disposed in a first orientation so as to circumscribe the metallic liner 12. This may be accomplished by cutting a sheet of prepreg graphite fibers and wrapping the sheet about the metallic liner 12 so that the fibers form a plurality of hoops disposed at about 90 degree angle to a long axis A—A of the metallic liner. In the alternative, the first layer 36 may be formed from a single graphite fiber which is wrapped in a tight spiral so that the fiber is continuously disposed at about 89 degrees from the long axis A—A. Those skilled in the art will appreciate that other angles can be used, preferably those within ±10 degrees of 90 degrees for the radially wound fibers and within ±10 degrees of the long axis for the longitudinally placed fibers. Thus, when used herein, "hoop winding" or "substantially perpendicular" to the long axis and "generally perpendicular" are intended to include the above identified range for the radially wound fibers. Likewise, "substantially longitudinally" and "generally parallel" to the long axis are intended to cover the above identified range of the longitudinally placed fibers.

In a preferred embodiment, the metallic barrel liner 12 is first wrapped with a fiberglass scrim cloth 34 coated with epoxy or resin. The scrim cloth 34 acts as an insulator to prevent corrosion between the electrically conductive metallic liner 12 and the electrically conductive graphite portion of the barrel casing 20.

Disposed on the first group 36 of fibers is the second group 40 of fibers which consists of elongate graphite fibers which are disposed parallel to the long axis A—A of the metallic liner. The elongate fibers of the second group 40 are disposed in a second orientation wherein the fibers are laid side to side about the circumference of the metallic liner 12 so as to form at least one generally continuous layer. Additional layers of fiber may be laid in the second orientation before another first group 36 of fibers are positioned about the second group 40 in the first orientation.

By varying the number of layers in the second group 40 of fibers with respect to each group of fibers disposed in the first orientation, the coefficient of thermal expansion for the composite casing 30 can be regulated to provide desired expansion characteristics. For example, in FIG. 1, the metallic liner 12 is wrapped by a first group 36 forming a single first layer. Eleven layers disposed in the second orientation to form the second group 40 are then overwrapped on the first layer 36. Another first group of fibers 36 disposed in the first orientation is placed about the second group 40, followed by another eleven layers forming another second group 48 of fibers. This alternating arrangement is repeated four to five times at any point along the metallic liner 12.

The eleven to one wrapping of the layers of the second group 40 relative to first group 36 provides a composite casing 20 which has expansion coefficients which closely match those of a stainless steel liner in the radial direction and has nominal or nearly 0 coefficient of thermal expansion in the axial direction. By closely matching the expansion coefficients of the casing 20 to the metallic liner 12 in the radial direction and maintaining nearly 0 coefficient of thermal expansion in the axial direction, the accuracy of the gun barrel 8 is preserved. Such matching between the composite casing 20 and the metallic liner are best achieved in graphite when using a between 8 and 12 layers in the second orientation for every layer in the first orientation. In other words, it is preferable to have about 8 to 12 times the amount of fiber by weight disposed in the second orientation that disposed in the first orientation.

Those skilled in the art will appreciate that a 12:1 to 8:1, etc., layer construction need not be used. For example, the layers could be replaced with a woven fabric having ten times the amount of fiber in one direction for every fiber in a substantially perpendicular direction or different winding angles could possibly be formulated to achieve the same result.

Instead of binding the metallic liner 12 and causing it to warp, the composite casing expands and contracts with the gun barrel in the radial direction. Those familiar with composite/metallic gun barrels will appreciate that the close match in coefficients of thermal expansion in the radial direction and nearly 0 coefficient of thermal expansion in the axial direction results in a more accurate gun.

Figure 3:
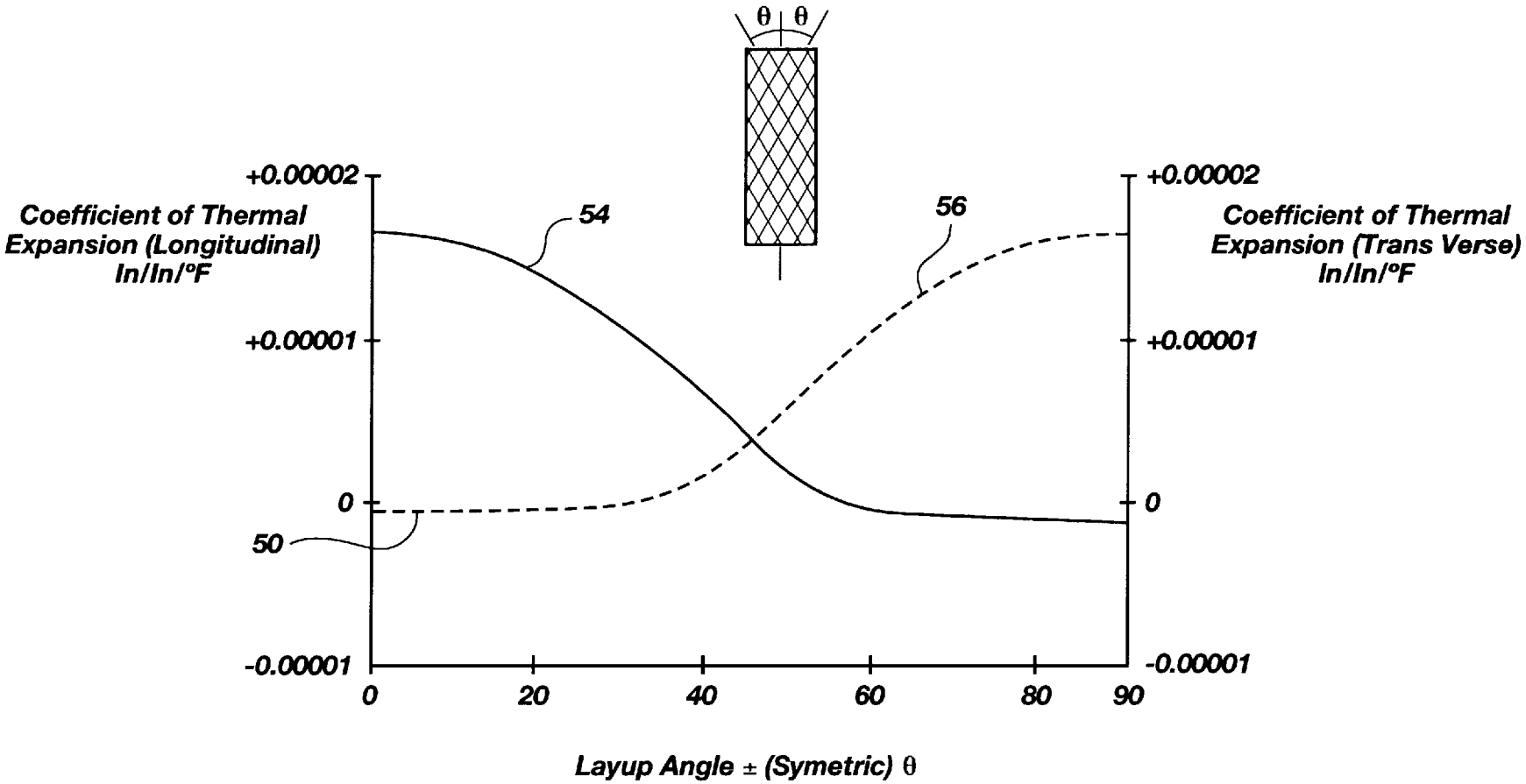
FIG. 3 shows a graph of the coefficient of thermal expansion in longitudinal and transverse directions relative to the angle of winding.

Referring now to FIG. 3, there is shown a graph of the coefficient of thermal expansion in longitudinal (axial) and transverse (radial) directions relative to the angle of winding. The graph includes a first, dashed curve 50 which shows that when the fibers are disposed longitudinally along the metallic lining, i.e. 0 degrees from the long axis of the metallic liner 14 (FIG. 2), the longitudinal coefficient of expansion for the fibers is slightly less than zero. In such a position, however, the transverse coefficient of expansion is almost 0.00002, as represented by curve 54. As the lay-up angle of the fibers is changed from 0 degrees to 90 degrees, the longitudinal coefficient of expansion changes from a slight negative to slightly less than +0.00002. The transverse coefficient of expansion, in contrast, decreases from nearly 0.00002 to slightly less than zero.

In the center of the two extremes, the two curves cross at a lay-up angle of approximately 45 degrees. In such a position, the composite casing 20 (FIGS. 1 and 2) of the gun barrel 8 (FIGS. 1 and 2) will expand in both longitudinal (axial) and transverse (radial) directions. This is a common lay-up angle used in the prior art. Unfortunately, such a lay-up angle lacks the similar expansion of the metallic liner 12 (FIGS. 1 and 2) available with a high ratio of longitudinal fibers to hoops fibers discussed with respect to FIG. 2.

Figure 4:
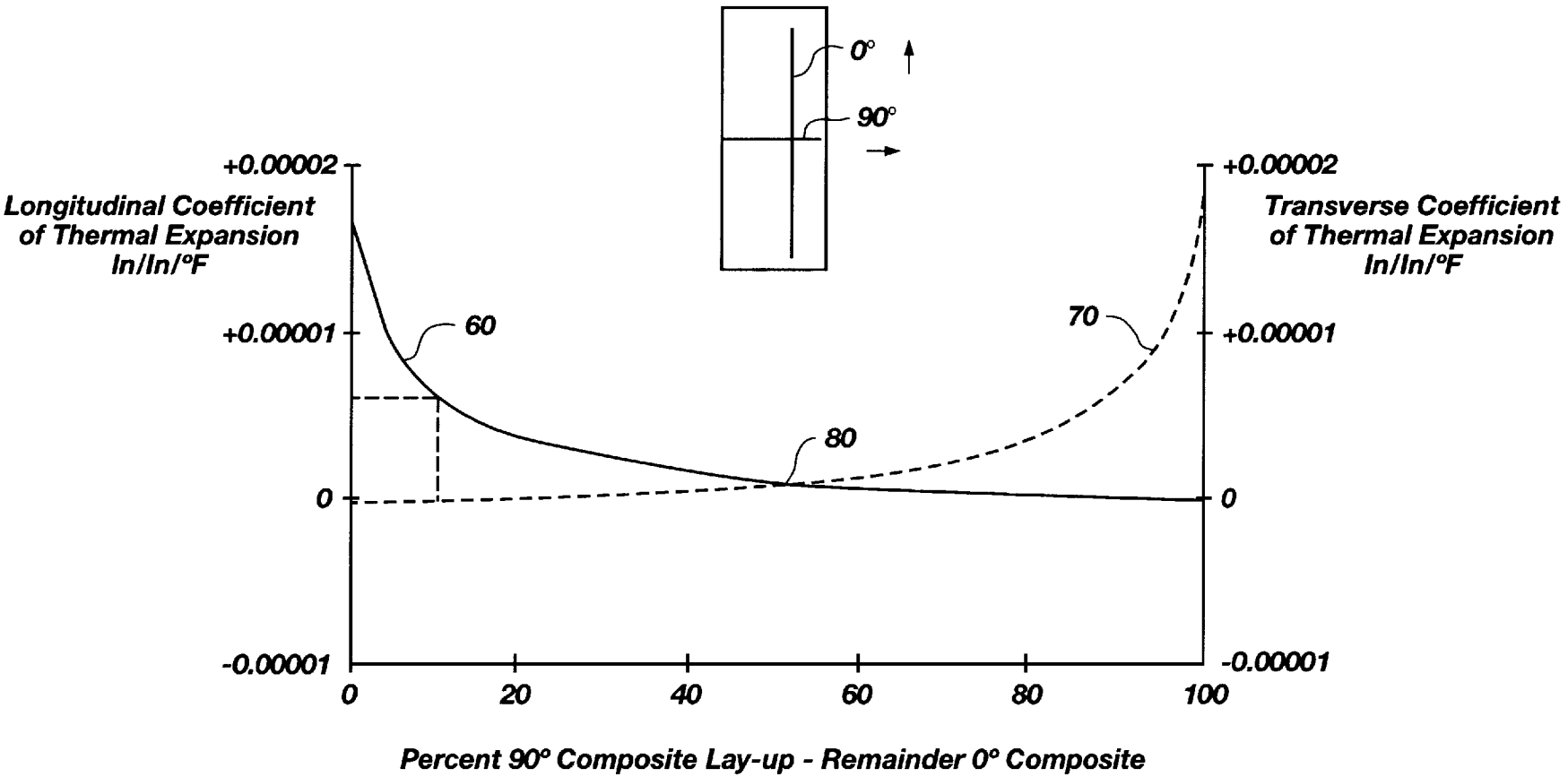
FIG. 4 shows a graph of longitudinal and transverse coefficients of thermal expansion as a function of the amount material placed longitudinally along the barrel versus the amount of material hoop or spiral wound about the barrel at an angle approximately 90 degrees to the long axis of the barrel.

FIG. 4 shows another graph in which the longitudinal coefficient of thermal expansion is shown relative to the percentage of transverse layers (90 degrees) relative to longitudinal layers (0 degrees). Beginning at the left of FIG. 4, there is shown a curve 60 representing the transverse coefficient of thermal expansion for the composite casing 20 (FIGS. 1 and 2). When the casing 20 has little or no fibers which are hoop or spiral wound at an angle close to 90 degrees, the casing has a transverse coefficient of thermal expansion of nearly 0.00002 in/in/° F. With approximately 10 percent fibers wound at approximately 90 degrees, the transverse coefficient of thermal expansion is about 0.000006 in/in/° F., the same coefficient of expansion as stainless steel, such as that which would be used in the metallic liner 12 of a gun barrel 8.

As the percentage of fibers which are wound at 90 degrees approaches 100 percent, the transverse coefficient of thermal expansion falls to slightly below zero. At such a level, the fibers would actually constrict against a metallic liner reducing the metallic barrel's radial expansion.

At the right of FIG. 4, a dashed curve representing the longitudinal coefficient of thermal expansion is indicated at 70. When the fibers of the composite casing 20 (FIGS. 1 and 2) are nearly 100 percent disposed in a 90 degree orientation, the longitudinal coefficient of thermal expansion is between 0.00001 and 0.00002. As the percentage of fibers wound at 90 degrees falls, the longitudinal coefficient of expansion decreases. When all of the fibers in the casing 20 are disposed along the long axis of the metallic liner, the longitudinal coefficient of thermal expansion is slightly less than zero.

If a liner other than stainless steel is desired to be used, the ratio of layers in the second orientation relative to the first orientation need only be modified to create a casing which matches the thermal expansion. Thus, for example, if a liner was chosen which had a transverse thermal expansion of 0.000008, the percentage of fibers in the first orientation (90 degrees) would be reduced. Typically, the casing would have one layer in the first orientation and then twelve to fourteen layers in the second orientation, repeated several times.

Thus, there is disclosed composite/metallic gun barrel having coefficients of thermal expansion which are matched to the expansion characteristics of the metallic liner. The method of making the gun barrel provides reduced barrel weight, while at the same time enhancing predictability in barrel performance despite changing temperatures during firing. The barrel is formed by making a barrel with a metallic liner with an exterior surface and an interior surface configured for firing a projectile. Multiple layers of reinforcing fiber are then applied in predetermined orientations along the exterior surface of the metallic liner in combination with thermosetting resin to form a surrounding composite shell which is subsequently cured. The orientations are configured so that the composite material develops a substantially zero coefficient of expansion in an axial direction of the barrel in response to changes from ambient temperature due to heating of the barrel during firing of the firearm; and a matched coefficient of expansion in a radial direction between coefficients of expansion of the respective composite and metallic liner to minimize expansion difference between the composite and that of the metallic liner.

In light of the above disclosure, those skilled in the art will recognize numerous modifications which can be made without departing from the scope and spirit of the present invention. The appended claims are intended to cover such modifications.

What is claimed is:

1. A method for reducing barrel weight in a firearm, while at the same time enhancing predictability in barrel performance despite changing temperatures during firing, said method comprising:

a) forming a barrel with a metallic liner having an exterior surface and an interior surface configured for firing a projectile;

b) applying multiple layers of reinforcing fiber in predetermined orientations along the exterior surface of the metallic liner in combination with thermosetting resin to form a surrounding composite shell which, subsequent to cure, develops:

i) a substantially zero coefficient of expansion in an axial direction of the barrel in the composite in response to changes from ambient temperature due to heating of the barrel during firing of the firearm; and ii) a matched coefficient of expansion in a radial direction between coefficients of expansion of the respective composite and metallic liner to minimize expansion of composite at a rate different from expansion of the metallic liner;

c) curing said composite to a final condition wherein thermal elongation changes in the barrel are generally uniform along axial and radial aspects of the barrel.

2. The method of claim 1, wherein the gun barrel liner has a long axis, and wherein step (b) comprises, more specifically, positioning a majority of the fibers by weight generally parallel to the long axis of the liner.

3. The method of claim 2, wherein a majority of fibers not disposed generally parallel to the long axis of the liner are disposed generally perpendicular to the long axis of the liner.

4. The method of claim 3, wherein the amount of fiber disposed generally parallel to the long axis of the liner is in a ratio of between about 8:1 and 12:1 with the amount of fiber disposed generally perpendicular to the long axis of the liner.

5. The method of claim 4, wherein the ratio of fiber disposed generally parallel to the long axis of the liner to the fiber disposed generally perpendicular to the long axis of the liner is about 10:1.

6. A method for forming a composite/metallic gun barrel with a desired coefficient of thermal expansion, the method comprising:

(a) selecting a metallic liner having a long axis and a known coefficient of thermal expansion in radial and axial directions;

(b) disposing a first group of fibers about the metallic liner in a first orientation at an angle generally perpendicular to the long axis of the liner; and (c) disposing a second group of fibers about the metallic liner in a second orientation generally parallel to the long axis of the liner, the first and second groups forming a composite casing, wherein the amount and orientation of fibers in the first group relative to the amount and orientation of fibers in the second group are coordinated to form the composite casing having a coefficient of thermal expansion in the radial direction with is substantially the same as the coefficient of thermal expansion of the liner in the radial direction, the composite casing having a nominal coefficient of thermal expansion in the axial direction.

7. The method according to claim 6, wherein step (c) comprises, more specifically, forming the second group of fibers from a sufficient amount of fibers disposed in the second orientation relative to the first group of fibers disposed in the first orientation that the resulting composite casing has a coefficient of thermal expansion in the radial direction which is the same as the coefficient of thermal expansion in the radial direction of the metallic liner.

8. The method according to claim 6, wherein step (a) comprises, more specifically, choosing a stainless steel liner, and wherein steps (b) and (c) comprise, more specifically, disposing the first and second groups of fibers in alternating layers, the layers formed from the second group of fibers having between about eight and twelve times the amount of fiber in each layer as the amount of fiber in each layer formed by the first group of fibers.

9. The method according to claim 8, wherein the composite casing is formed by wrapping graphite fibers coated with epoxy about the metallic liner and curing the fibers.

10. The method according to claim 6, wherein steps (b) and (c) comprise, more specifically, wrapping graphite fibers coated with epoxy about a mandrel;

curing the fibers and epoxy so as to form a hardened casing;

removing casing from the mandrel; and disposing the hardened casing about the metallic liner.

11. The method according to claim 6, wherein the method further comprises placing an insulative layer about the metallic liner before performing step (b).

12. The method according to claim 11, wherein step (a) comprises, more specifically, selecting a metallic liner having a long axis and wrapping the liner in a fiberglass cloth coated with epoxy.

13. A composite/metallic gun barrel comprising:

a metallic liner having a long axis;

a first group of nonrandom graphite fibers disposed about the metallic liner in a first orientation generally perpendicular to the long axis of the metallic liner; and a second group of nonrandom graphite fibers disposed about the metallic liner and the first layer, each of the fibers in the second group being disposed in a second orientation generally parallel with the long axis of the metallic liner, the amount of fiber being disposed in the second orientation being greater than the amount of fiber disposed in the first orientation.

14. The composite/metallic gun barrel of claim 13, wherein the gun barrel comprises a plurality of layers formed alternatingly from fibers of the first group and fibers of the second, each layer containing fibers from the first group being disposed adjacent to a layer containing fibers of the second group.

15. The composite/metallic gun barrel of claim 13, wherein each layer comprising fibers from the second group of fibers has between about 8 and 12 times the amount of fibers as the layers comprising fibers from the first group of fibers.

16. The composite/metallic gun barrel of claim 15, wherein each layer comprising fibers from the first group of fibers comprises a single layer of fibers.

17. The composite metallic gun barrel of claim 15, wherein the metallic liner comprises stainless steel.

18. The composite/metallic gun barrel of claim 13, wherein the metallic liner has a coefficient of thermal expansion in the radial direction, and wherein the first and second groups of fibers form a composite casing having a coefficient of thermal expansion in the radial direction which is the about the same as the coefficient of thermal expansion in the radial direction of the metallic liner.

* * * * *